United States Patent [19]

Noshi et al.

[11] Patent Number: 4,703,900

[45] Date of Patent: Nov. 3, 1987

[54] SYSTEM OF CONTROLLING THE WINDING OPERATION OF AUTOMATIC WINDERS

[75] Inventors: Shinji Noshi, Yawata; Yasuo Okuyama, Ohtsu, both of Japan

[73] Assignee: Murata Kikai Kabushiki Kaisha, Kyoto, Japan

[21] Appl. No.: 846,897

[22] Filed: Apr. 1, 1986

[30] Foreign Application Priority Data

Apr. 5, 1985 [JP] Japan ..... 60-72189

[51] Int. Cl.[4] ..... B65H 54/26; B65H 63/00

[52] U.S. Cl. ..... 242/35.5 R; 242/35.6 R; 242/36; 242/39

[58] Field of Search ..... 242/35.5 R, 35.5 A, 242/35.6 R, 36, 37 R, 39

[56] References Cited

U.S. PATENT DOCUMENTS

| | | | |
|---|---|---|---|
| 2,733,870 | 2/1956 | Furst | 242/35.6 R |
| 3,092,340 | 6/1963 | Furst | 242/35.5 R |
| 3,121,540 | 2/1964 | Furst | 242/35.5 R |
| 3,184,174 | 5/1965 | Furst | 242/35.5 R |
| 3,802,637 | 4/1974 | Maassen | 242/35.6 R |
| 4,512,526 | 4/1985 | Tone et al. | 242/35.6 R X |

*Primary Examiner*—Stanley N. Gilreath

*Attorney, Agent, or Firm*—Spensley Horn Jubas & Lubitz

[57] ABSTRACT

A system of controlling the winding operation of an automatic winder which includes a yarn joining device and a yarn cutting device disposed along the yarn running passage between a package and a spinning bobbin, comprising steps of cutting the yarn in response to a full-package signal, executing a yarn joining operation, and providing a doffing signal to instruct the relevant mechanism to execute doffing operation.

9 Claims, 3 Drawing Figures

SYSTEM OF CONTROLLING THE WINDING OPERATION OF AUTOMATIC WINDERS

FIELD OF THE INVENTION AND RELATED ART STATEMENT

The present invention relates to a winding system of automatic winders.

Generally, spinning bobbins produced on a fine spinning frame are rewound on an automatic winder to wind the fine-spun yarn in a yarn package having a quantity and shape which are suitable for the following process. While the spinning bobbins are rewound on an automatic winder, defects in the yarn, such as neps and slubs, are removed from the yarn. In rewinding spinning bobbins, the yarn drawn out from the spinning bobbin is passed through a tension device and a slub catcher and is wound on a take-up tube in a yarn package which is in contact with and is being driven by a traverse drum, as the yarn is reciprocated along the circumference of the yarn package by the traverse drum. When the length of the yarn wound on the yarn package or the diameter of the yarn package reaches a predetermined value, the winding operation is interrupted and the full package is doffed.

In such an automatic winder, upon the generation of a full package signal, the traverse drum is disconnected from the driving source so that the traverse drum will stop spontaneously. The slub catcher is rendered inactive when the yarn speed decreases to a certain level or upon the generation of the full package signal. After the traverse drum has stopped, doffing operation is started to doff the full package.

Such a doffing procedure has the following problems. Since the traverse drum rotates for a little while by inertia after the full package signal has been provided, an excessive length of yarn, for example, 100 to 300 m of yarn in some automatic winder, is wound on the full package before the traverse drum stops. Furthermore, since the slub catcher remains inactive while the traverse drum rotates by inertia, a length of uninspected yarn, namely, a length of yarn possibly having defects such as slubs and neps, is wound on the full package. Accordingly, such a conventional doffing procedure entails difference between full packages in yarn length and winding faulty pieces of yarn on the yarn package. Furthermore, since the driving motor is stopped and hence the ribbon breaker is inactive while the traverse drum is rotating by inertia, it is possible that ribbons are formed over the circumference of the full package.

OBJECT AND SUMMARY OF THE INVENTION

It is an object of the present invention to propose a system of controlling the winding operation whereby a full package having an accurate size and having only good yarn wound thereon can be obtained.

The object of the present invention is achieved by a system of controlling the winding operation of automatic winders, comprising steps of cutting the yarn in response to a full-package signal, executing a yarn joining operation, and providing a doffing signal to instruct the relevant mechanism to execute doffing operation.

DETAILED DESCRIPTION OF PREFERRED EMBODIMENTS

The present invention will be described with reference to a device for carrying out the present invention in conjunction with the accompanying drawings.

Figure 2:
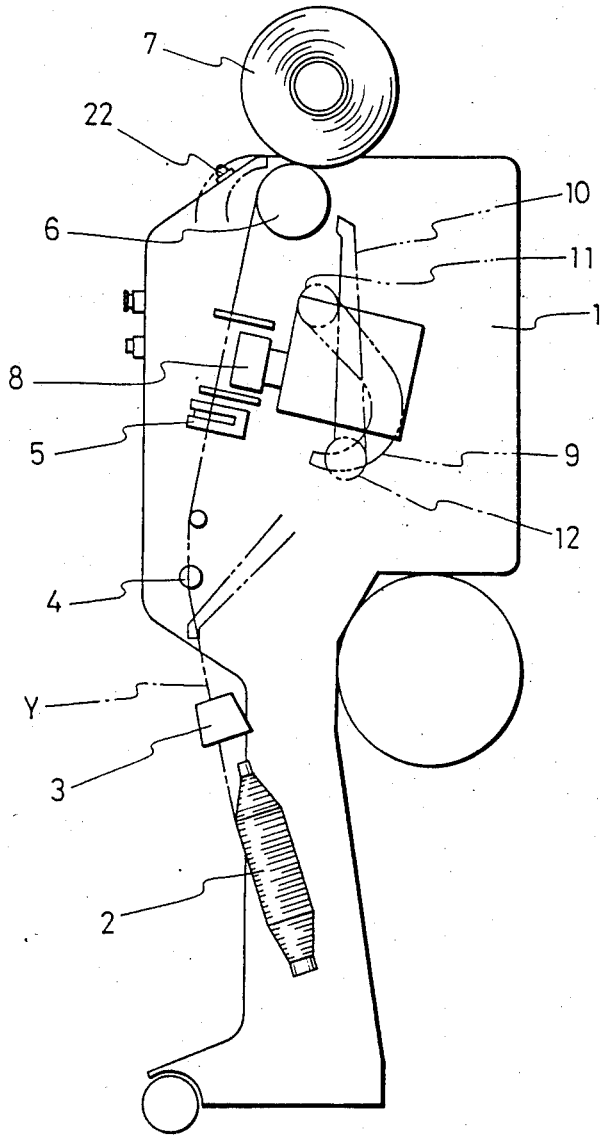
FIG. 2 is a schematic side elevation showing the general constitution of an example of an automatic winder.

FIG. 2 illustrates the winding unit 1 of a typical automatic winder. A yarn Y drawn out from a spinning bobbin 2 is passed through a baloom breaker 3, a tension device 4 and a slub catcher 5 and is wound on a package 7 being rotated by a traverse drum 6. The winding unit 1 is provided with a yarn joining device 8, a suction arm 9 and an intermediate pipe 10. The suction arm 9 and the intermediate pipe 10 guide yarn ends to the yarn joining device 8. The suction arm 9 sucks the yarn end of the yarn wound on the yarn package 7, and then turns on a shaft 11 to bring the yarn end to the yarn joining device 8. The intermediate pipe 10 sucks the yarn end of the yarn of the spinning bobbin 2, and then turns on a shaft 12 to bring the yarn end to the yarn joining device 8. A pilot lamp 22 is turned on to request doffing operation as soon as the yarn Y is wound on the yarn package 7 to the full. Upon the detection of defects, such as slubs, in the yarn, the slub catcher 5 produces a slub detection signal, actuates a separate yarn cutting device incorporated into the slub catcher 5 to cut the yarn. The slub catcher 5 is capable also of detecting the presence of the yarn in the yarn passage. Naturally, the detection of defects in the yarn, cutting the yarn and yarn detection may be assigned to separate means, respectively. In this embodiment, the presence of yarn in the yarn passage is detected electrically or optically by the slub catcher. However, it is also possible to detect the presence of yarn in the yarn passage by a mechanical detector having a moveable detecting member disposed in the yarn passage so that the moveable detecting member is held in place in the yarn passage by the agency of yarn tension while a yarn is present in the yarn passage and is caused to drop away from the yarn passage by the gravity when yarn is absent in the yarn passage.

Figure 3:
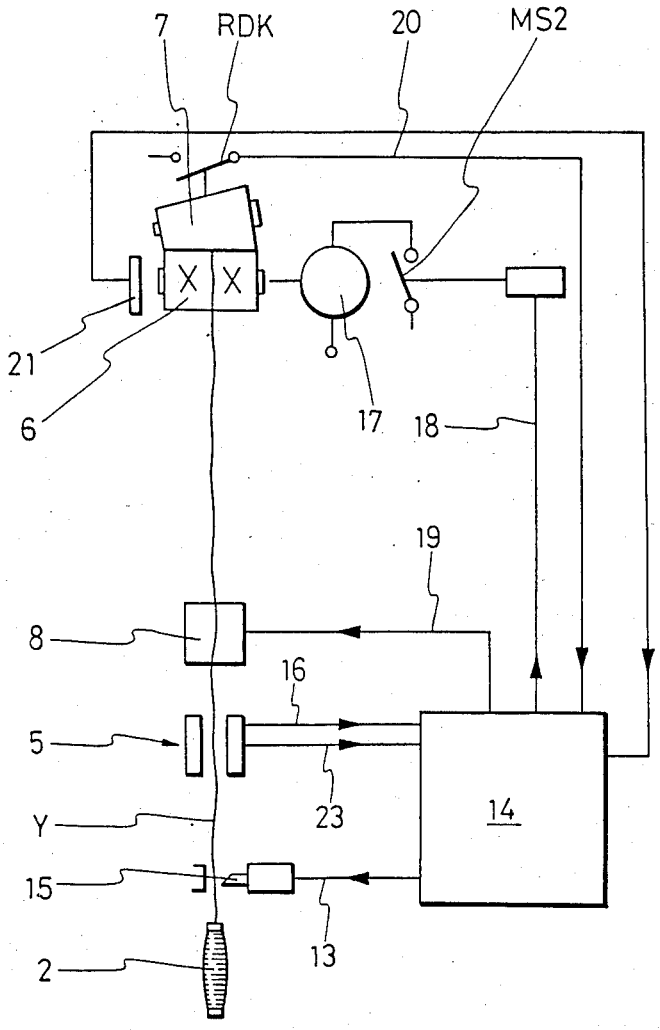
FIG. 3 is a block diagram of a signal transmission system for a winding unit.

The manner of the normal winding operation of the winding unit 1 will be described with reference to FIG. 3.

Upon the detection of a defect, such as a slub, in the yarn Y being drawn out from the spinning bobbin 2 during the normal winding operation, the slub catcher 5 gives a defect detection signal 23 to a control unit 14. Then the control unit 14 gives a yarn cutting command signal 13 to the yarn cutting device 15 to actuate the same for yarn cutting operation. Upon the detection of the passage of the end of the yarn being wound on the yarn package 7 through the slub catcher 5 by a yarn feeler, the slub catcher 5 gives a yarn absence signal 16 to the control unit 14, and then the control unit 14 gives a stop signal 18 to a drum driving motor 17 to stop the traverse drum 6. After the traverse drum 6 has stopped, the control unit 14 provides a yarn joining command signal 19 to actuate the yarn joining device 8 for yarn joining operation. Upon the completion of the yarn joining operation, the drum driving motor 17 is actuated to restart the yarn winding operation.

On the other hand, when the length of the yarn wound on the yarn package 7 or the diameter of the yarn package 7 reaches a predetermined value, a full package signal 20 is given to the control unit 14, and then the control unit provides the yarn cutting command signal 13 to actuate the yarn cutting device 15. Thus, the yarn Y is cut, the drum driving motor is stopped and the traverse drum stops when the full package signal 20 is provided. Accordingly, the yarn Y is not wound on the yarn package during the inertial rotation of the traverse drum 6, and hence the yarn Y is not drawn out from the spinning bobbin 2 and any excessive length of uninspected yarn is not wound on the yarn package during the inertial rotation of the traverse drum 6.

The known automatic doffing device is unable to carry out automatic doffing operation unless the yarn is extended continuously between the spinning bobbin 2 and the yarn package 7. Therefore, when the automatic winder is equipped with such a known automatic doffing device, a yarn joining operation is executed prior to the automatic doffing operation. Upon the completion of the yarn joining operation, a doffing request signal is provided. Then, the request for doffing operation is indicated by the pilot lamp 22 provided in the winding unit, which is detected by an optical sensor provided on a carriage mounted with the doffing device and traveling along the line of the winding units 1.

Figure 1:
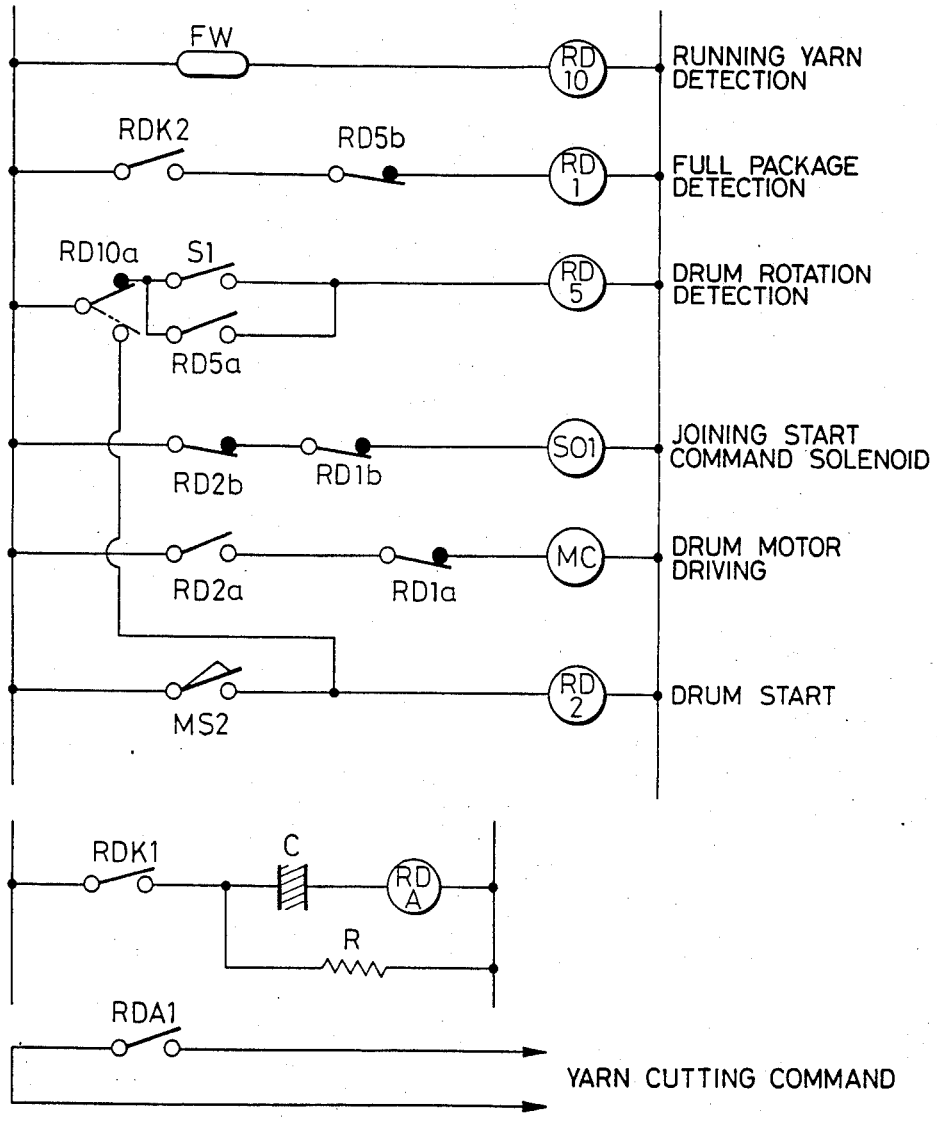
FIG. 1 is a sequence circuit diagram of an example of a control circuit for carrying out the present invention.

FIG. 1 illustrates an exemplary relay circuit incorporated into the control unit 14 for the above-mentioned sequential control operation.

When the full package signal is given to the control unit 14, a contactor RDK1 for a relay RDA is closed, and then a single shot circuit consisting of a resistance R and a condenser C energizes the relay RDA momentarily to close the normally open contact RDA1 of the relay RDA, and thereby the yarn cutting command signal 13 is provided to actuate the yarn cutting device. A cutter operated by a solenoid is employed suitably as the yarn cutting device.

Another normally open contactor RDK2 is closed when the full package signal is provided, to energize a relay RD1, and thereby the normally closed contact RD1a of the relay RD1 is opened to de-energize a relay MC for the drum driving motor 17, so that the drum driving motor 17 is disconnected from the power source. During the inertial rotation of the traverse drum, a relay RD10 is de-energized when the yarn feeler FW changes its position to an off-position, and thereby the contact RD10a of the relay R10 is caused to change its position to a position indicated by a continuous line. At this moment, the traverse drum is still rotating by inertia and the continuation of rotation of the traverse drum is detected by a drum rotation detector 21 and the drum rotation detecting switch S1 is closed. Accordingly, while the traverse drum is rotating by inertia, a relay RD5 is energized, the normally open contact RD5a of the relay RD5 is held closed, the normally closed contact RD5*b* of the relay RD5 is opened and a relay RD1 is de-energized. Therefore, although the normally closed contact RD1a of the relay RD1 for connecting the drum driving motor to the power source is closed, the contact RD10*a* of the relay RD10 has been changed to a position indicated by a continuous line, and thereby a relay RD2 is de-energized. Therefore, the normally open contact RD2*a* of the relay RD2 is opened, and hence the relay MC of the drum driving motor is never energized.

Since the normally closed contacts RD1b and RD2*b* of the relay RD1 for yarn joining commanding are closed, a solenoid SO1 is energized to start yarn joining operation. Upon the completion of the yarn joining operation, a traverse drum starting switch MS2 is closed, a relay RD2 is energized, the normally open contact RD2*a* of the relay RD2 of the motor driving circuit is closed and the relay MC is energized to start driving the traverse drum.

When the yarn joining operation is successful, the yarn feeler FW changes its position to an on-position, the relay RD10 is energized, and thereby the contact RD10*a* of the relay RD10 is changed to a position indicated by a broken line. Consequently, the relay RD5 is de-energized, the normally closed contact RD5*b* of the relay RD5 is closed, the relay RD1 is energized, the normally closed contact RD1*a* of the relay RD1 in the motor driving circuit is opened to de-energize the relay MC, so that the drum driving motor is stopped immediately. In this process, since the drum driving motor is stopped before the revolving speed of the traverse drum reaches the normal revolving speed, the traverse drum may be stopped relatively quickly. Thus, the traverse drum stops with the yarn continuously extending between the spinning bobbin and the yarn package, and then the doffing request signal is provided.

The completion of a full package may be detected by a detecting means which provides a full package signal by actuating a microswitch with the arm of the cradle supporting the yarn package when the angle of turning of the cradle reaches a predetermined value or by a detecting means which counts the number of revolution of the traverse drum 6 with a pulse counter and provides a full package signal when the number of revolution reaches a predetermined value.

The yarn length necessary for yarn joining operation is approximately 1 m for a yarn package and approximately 10 m for a spinning bobbin. However, it is preferable to wind, at most, an additional three meters of yarn for three times of yarn joining operation on the full package taking into consideration the possibility of failure in yarn joining operation. This, is far more efficient than the conventional control system,in which 100 to 300 m of excessive yarn is wound on a full package.

Suppose that the length of yarn wound on one spinning bobbin is 5000 m and 200 m of yarn is wound on a full package during the inertial rotation of the traverse drum after the detection of a full package in the conventional system of controlling winding operation. Then, the probability of exhaustion of the yarn wound on the spinning bobbin is 200/5000=4%. Suppose that the length of yarn wound on a full package after the detection of the full package is 2 m in this embodiment. Then, the probability is 2/5000=0.04% ÷0, and hence the probability of continuation of yarn between the spinning bobbin and the full package when the traverse drum is stopped after the detection of the full package is practically 100%.

As apparent from the foregoing description, according to the present invention, the yarn cutting operation is executed in response to a full package signal, and then a doffing request signal is provided after the completion of the yarn joining operation. Therefore, only the inspected yarn is wound in a full package having an accurate size and winding uninspected faulty yarn on the full package is prevented. Furthermore, since yarn joining operation is executed immediately after the completion of yarn cutting operation, doffing operation can be started immediately.

Still further, ribboning due to the absence of the action of the ribbin breaker during the inertial rotation of the traverse drum after the detection of the full package is prevented, because only a short length of yarn is wound additionally on the full package after the detection of the full package.

Thus, according to the present invention, only good yarn not having any fault is wound in a full package having an accurate size and the full package is formed in a very satisfactory shape free from fault such as ribbons.

What is claimed is:

1. A method of controlling the winding operation of an automatic winder for winding yarn from a spinning bobbin onto a yarn package, comprising the steps of:

detecting the fully wound condition of said yarn package;

cutting the yarn between said spinning bobbin and said yarn package in response to the detected fully wound condition of said yarn package to thereby provide a first cut yarn portion associated with said spinning bobbin and a second cut yarn portion associated with said yarn package;

joining said first cut yarn portion and said second cut yarn portion; and providing a package doffing signal in response to the execution of said yarn joining operation.

2. An automatic winder for winding yarn from a spinning bobbin onto a yarn package, comprising:

a traverse drum connected with a drum driving motor for contacting the yarn package to rotate the yarn package;

a yarn joining device, operable for joining yarn on said spinning bobbin with yarn on said yarn package;

first detection means for detecting defects in the yarn;

a yarn cutting device, operable for cutting the yarn;

second detection means for detecting the fully wound condition of said yarn package a doffing display means for providing a display in response to fully wound condition of the yarn package, for indicating a full yarn package in condition to be doffed; and a control unit for controlling doffing operation of the full yarn package connected with said traverse drum driving motor, yarn joining device, first detection means, yarn cutting device, second detection means, and said doffing display means.

3. An automatic winder as claimed in claim 2, wherein said second detection means provides a full package signal in response to the fully wound condition of the yarn package, and said control unit provides a yarn cutting command signal in response to the full package signal, for actuating said yarn cutting device to cut the yarn and for stopping the drum driving motor.

4. An automatic winder as claimed in claim 3, wherein said control unit provides a yarn joining command signal, after stopping of the drum driving motor, for actuating the yarn joining device, and a doffing request signal in response to the completion of the yarn joining operation.

5. A method for controlling the winding operation of an automatic winder having a spinning bobbin and a yarn package, comprising the steps of:

detecting the fully wound condition of the yarn package;

cutting the yarn extending between the yarn package and the spinning bobbin;

joining the yarn wound on the yarn package with the yarn on the spinning bobbin detecting the successful joining of yarn wound on the yarn package with the yarn on the spinning bobbin; and providing a doffing request signal in response to the successful joining of yarn wound on the yarn package with the yarn on the spinning bobbin.

6. An automatic winder for winding yarn from a spinning bobbin onto a yarn package, comprising:

first detection means for detecting the fully wound condition of the yarn package;

cutting means responsive to the fully wound condition of the yarn package for cutting the yarn;

joining means operable for joining the yarn wound on the yarn package with the yarn on the spinning bobbin;

second detection means for detecting a successful yarn joining operation provided by said joining means; and signalling means for providing a doffing request signal in response to a successful yarn joining operation.

7. An automatic winder as claimed in claim 6, further comprising:

drive means for rotatably driving said yarn package; and deactivation means, responsive to the fully wound condition of the yarn package, for deactivating said drive means.

8. In an automatic winder wherein yarn is drawn-out from a spinning bobbin and wound about a yarn package, the improvement comprising:

detection means for detecting the fully wound condition of the yarn package;

cutting means responsive to the fully wound condition of the yarn package, for cutting the yarn extending between the yarn package and the spinning bobbin, thereby limiting the length of yarn wound about the yarn package;

joining means for joining yarn wound about said yarn package with yarn drawn out from said spinning bobbin, thereby enabling the yarn to extend continuously between the yarn package and the spinning bobbin; and signalling means for providing a doffing request signal in response to the joining of yarn wound about said yarn package with yarn on said spinning bobbin.

9. An automatic winder wherein yarn is drawn out from a spinning bobbin and wound onto a yarn package, comprising:

first detection means for detecting a fault condition in said yarn;

second detection means for detecting the fully wound condition of the yarn package;

cutting means, responsive to either one of said fault condition in said yarn and said fully wound condition of the yarn package, for cutting the yarn;

joining means operable for joining the yarn wound on the yarn package with the yarn on the spinning bobbin in response to the cutting of the yarn by said cutting means when the yarn is cut in response to either one of said fault condition in said yarn and said fully wound condition of the yarn package.

* * * * *